US005951017A

United States Patent [19]

Wang

[11] Patent Number: 5,951,017

[45] Date of Patent: Sep. 14, 1999

[54] ASSEMBLY OF FLEXIBLE METAL CONTACT BARS FOR COIN-OPERATED PATH GAME UNIT

[75] Inventor: Yu Chu Wang, Taipei Hsien, Taiwan

[73] Assignee: Amuchine Enterprise Co., Ltd., Taipei Hsien, Taiwan

[21] Appl. No.: 09/019,004

[22] Filed: Feb. 5, 1998

[51] Int. Cl.[6] ..... A63B 71/04

[52] U.S. Cl. ..... 273/441; 273/454; 273/455; 273/459; 273/460

[58] Field of Search ..... 273/454, 440, 273/441, 442, 455, 459, 460

[56] References Cited

U.S. PATENT DOCUMENTS

| | | | |
|---|---|---|---|
| 4,239,213 | 12/1980 | Jarvis | 273/441 |
| 4,892,306 | 1/1990 | Kawar | 273/441 |
| 5,062,647 | 11/1991 | Chanter et al. | 273/442 |
| 5,265,889 | 11/1993 | Kojima | 273/442 |
| 5,346,398 | 9/1994 | Nakahata et al. | 273/442 X |

*Primary Examiner*—Raleigh W. Chiu
*Attorney, Agent, or Firm*—Smith, Gambrell & Russell, LLP; Beveridge, DeGrandi, Weilacher & Young Intellectual Property Group

[57] ABSTRACT

Disclosed is an assembly of flexible metal contact bars for a coin-operated path game unit. The assembly includes a fixed supporting block having a rubber-ring-attached shaft frictionally contacting with a driven sliding block having a rubber-pad-attached top. Two electrodes are fixedly attached to the sliding block and extend toward a rotating spiral path in the game unit. When the path game unit is actuated by an inserted coin, the shaft of the fixed supporting block rotates with the rubber ring thereof frictionally contacting with the rubber pad on the driven sliding block to move the sliding block toward the path, so that the two electrodes separately locate above and below the path. The electrode each is formed from at least two metal contact bars flexibly connected to one another by a spring between them, such that the metal contact bar forming a free end of the electrode may bias in any direction to avoid damage when the electrode collides with the path.

4 Claims, 5 Drawing Sheets

ASSEMBLY OF FLEXIBLE METAL CONTACT BARS FOR COIN-OPERATED PATH GAME UNIT

FIELD OF THE INVENTION

The present invention relates to an assembly of flexible metal contact bars for a coin-operated path game unit. The assembly includes a fixed supporting block with rubber-ring-attached shaft frictionally contacting with a driven sliding block with a rubber pad on top of it. Two electrodes are fixedly attached to the sliding block and extend toward a rotating spiral path. When the path game unit is actuated by an inserted coin, the shaft on the fixed supporting block rotates and the frictional contact of the rubber ring with the rubber pad causes the sliding block to move toward the path with the two electrodes separately locating at two sides of the path. The electrode each is formed from two or more metal contact bars flexibly connected to one another by a spring between them, such that the metal contact bars forming free ends of the electrodes may bias in any direction to avoid damage due to collision of the electrode with the path.

DESCRIPTION OF THE PRIOR ART

There is a game in which a forward or backward extended rigid straight contact bar is held by a player to move along a certain preset path as quick as possible. The path is supplied with electric current and the player is not permitted to touch any border of the path with the contact bar, or else there will be a warning signal and the player will lose the game. Similar game can be proceeded in a coin-operated machine and such machine can be referred to as a coin-operated path game unit.

Since the contact bar used in the path game is made of rigid metal material and is moved at very quick speed during the game, it often directly collides with the path to cause undesired and quick wear of the contact bar. Moreover, the rigid contact bar might collide with the path at any position thereof and from any direction, it tends to irregularly bend and lose its accuracy in the game after being used for a period of time. Therefore, the contact bar must be frequently replaced with a good one to maintain a fair game.

SUMMARY OF THE INVENTION

A primary object of the present invention is to provide an assembly of flexible metal contact bars for a coin-operated path game unit, so that the flexible metal contact bars may absorb any impact when they collide with the path from any direction without being stuck in the path or causing a damaged motor of the game unit.

Another object of the present invention is to provide an assembly of flexible metal contact bars for a coin-operated path game unit, wherein the metal contact bars are made of stainless steel material to provide good conductivity and long usable life.

A further object of the present invention is to provide an assembly of flexible metal contact bars for a coin-operated path game unit, wherein the contact bars can be controlled to safely move away from the path before and after the game. No accidental collision or damage will occur before and after the game.

BRIEF DESCRIPTION OF THE DRAWINGS

The technical means adopted by the present invention to achieve the above and other objects can be best understood by referring to the following detailed description of the preferred embodiment and the accompanying drawings, wherein.

DETAILED DESCRIPTION OF THE PREFERRED EMBODIMENT

Figure 1:
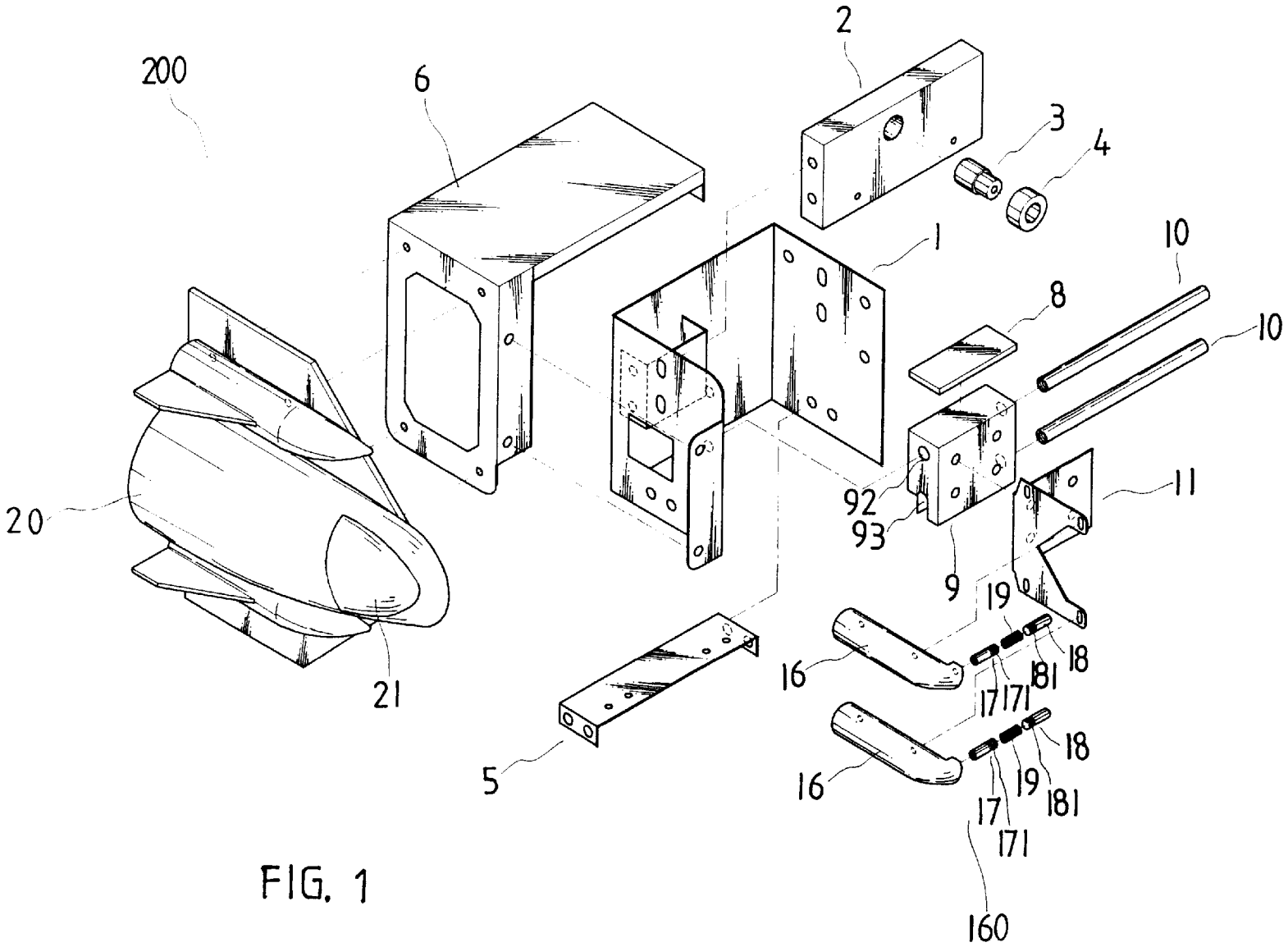
FIG. 1 is an exploded perspective of the present invention.
Figure 2:
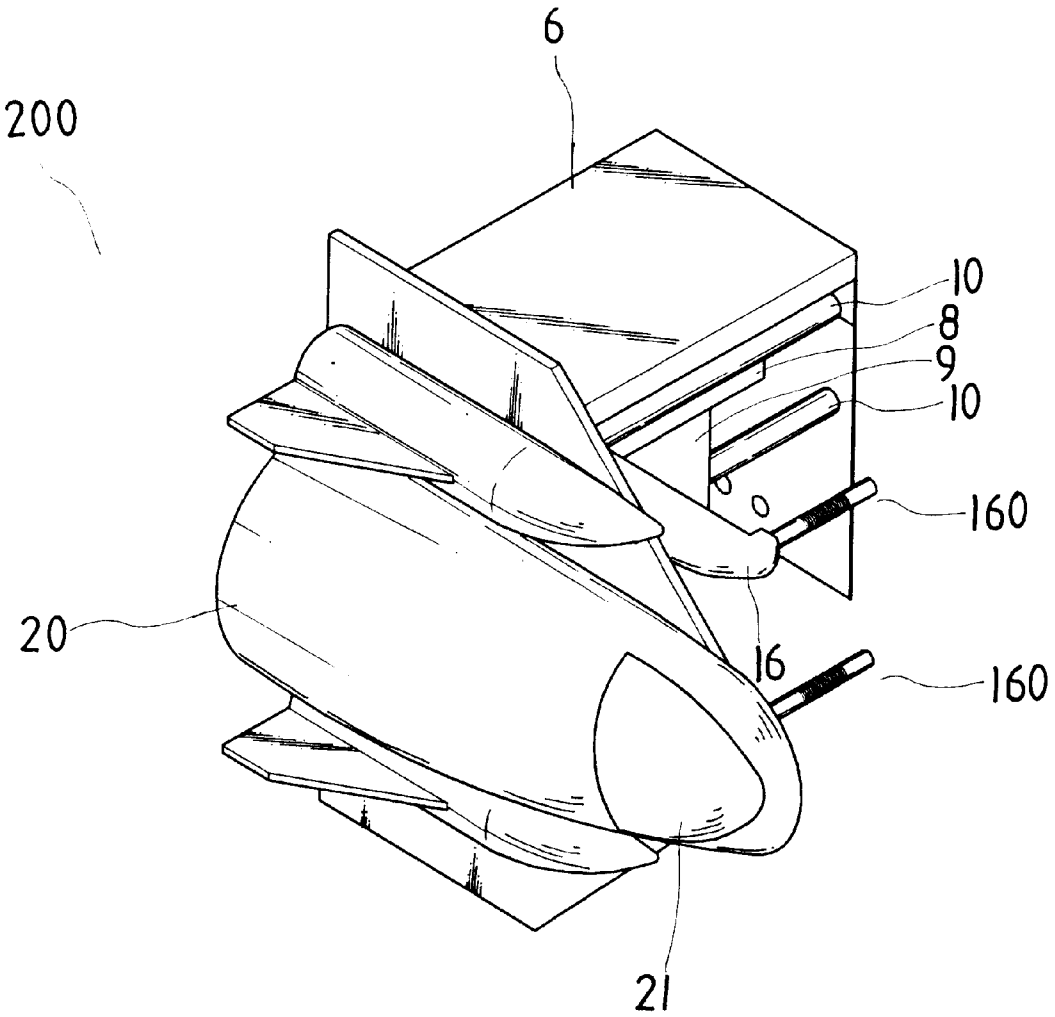
FIG. 2 is an assembled perspective of the present invention.
Figure 3:
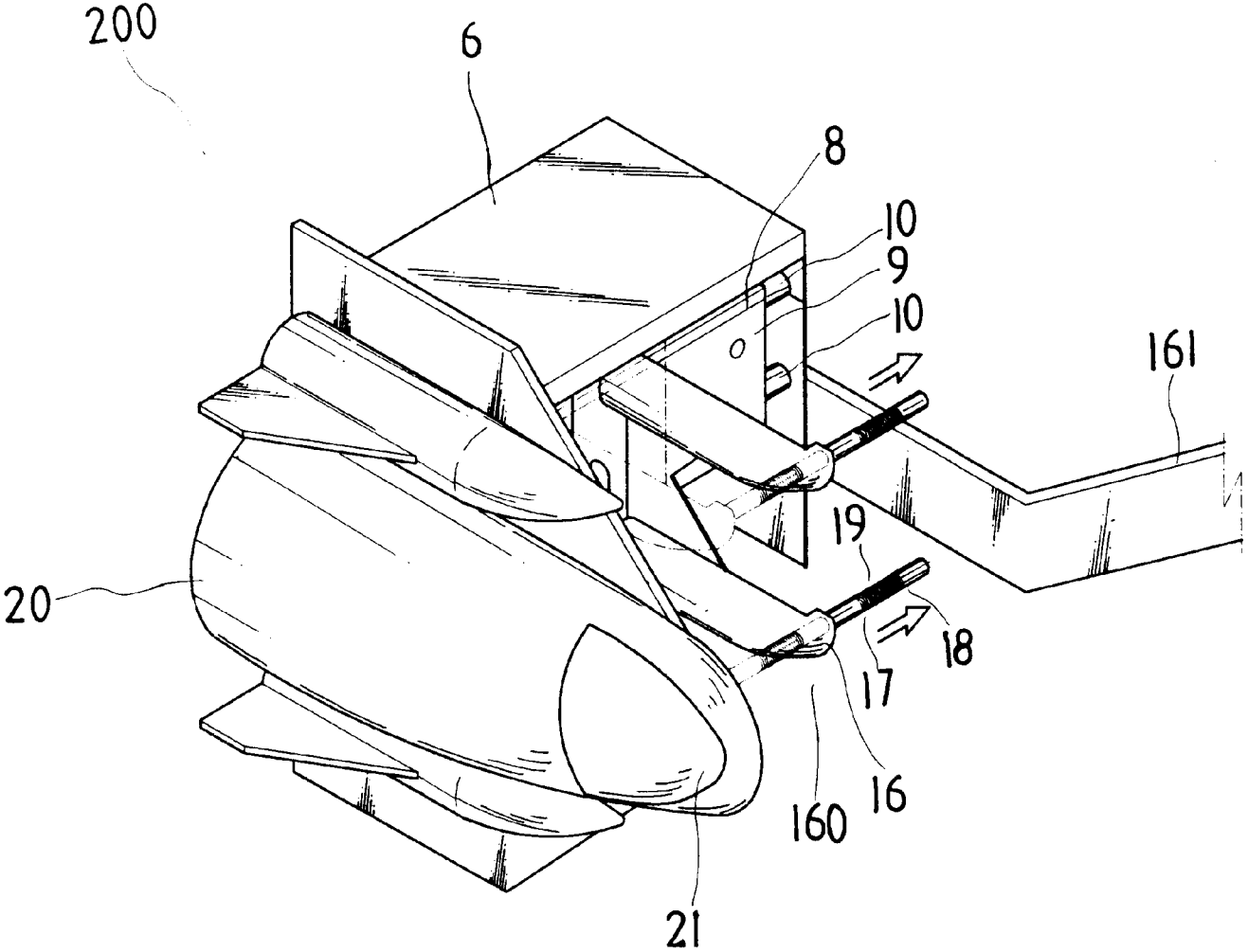
FIG. 3 shows that the present invention is mounted in a path game unit and is moved toward the path into a ready position after the game unit is actuated.

Please refer to FIGS. 1 and 2 which are exploded and assembled perspective views of the present invention, respectively. The present invention relates to an assembly 200 of flexible metal contact bars for a path game unit 100. The assembly 200 mainly includes a frame 1. A motor (not shown), a supporting block 2, and an n-shaped supporting bracket 5 are respectively mounted in the frame 1 at an upper, a middle, and a lower portion thereof. A shaft 3 rotatably connected to the motor sideward projects from a central portion of the supporting block 2 and has a rubber ring 4 mounted around an outer end of the shaft 3. A cover 6 is covered on the frame 1 and a decorative shell 20 with a clear window 21 is mounted to a front side of the cover 6. A driven sliding block 9 with upper and lower shaft holes 92, 93 is positioned in the frame 1 to one side of the supporting block 2. Two guide rails 10 are fixed to the frame 1 and separately extend through the upper and the lower shaft holes 92, 93 of the driven sliding block 9, so that the sliding block 9 may slide along the guide rails 10. A driven rubber pad 8 is attached to a top of the driven sliding block 9, such that the rubber pad 8 locates below and contacts with the rubber ring 4. A right-angled member 11 is connected at one side to the driven sliding block 9 with another side having a V-shaped opening formed thereon sideward and perpendicularly projecting from the driven sliding block 9 to serve as an electrode fixing plate. Two insulating electrode holders 16 are separately attached to two outer sides of the V-shaped opening of the electrode fixing plate 11. Each electrode holder 16 holds an electrode 160 at a free end thereof. Both the electrodes 160 point toward a path 161 of the path game unit 100 and each consists of a first contact bar 17, a second contact bar 18, and a spring 19. The first contact bar 17 is fixedly and perpendicularly connected at one end to the free end of the electrode holder 16. Another end of the first contact bar 17 and an end of the second contact bar 18 facing the spring 19 are provided with threads 171, 181, respectively, so that the spring 19 may be manually screwed at two ends to the first and the second contact bars 17, 18. That is, each electrode 160 is actually a two-piece member. However, the electrode 160 may be a multi-piece member, if desired. The first and the second contact bars 17, 18 and the springs 19 are preferably made of stainless steel. The spring 19 allows the second contact bar 18 to bias when the electrode 160 accidentally collides with the path 161 provided in the path game unit 100. The biased second contact bar 18 shall immediately return to its original position without being stuck in the path 161 as soon as the electrode 160 is moved away from the path 161.

Figure 5:
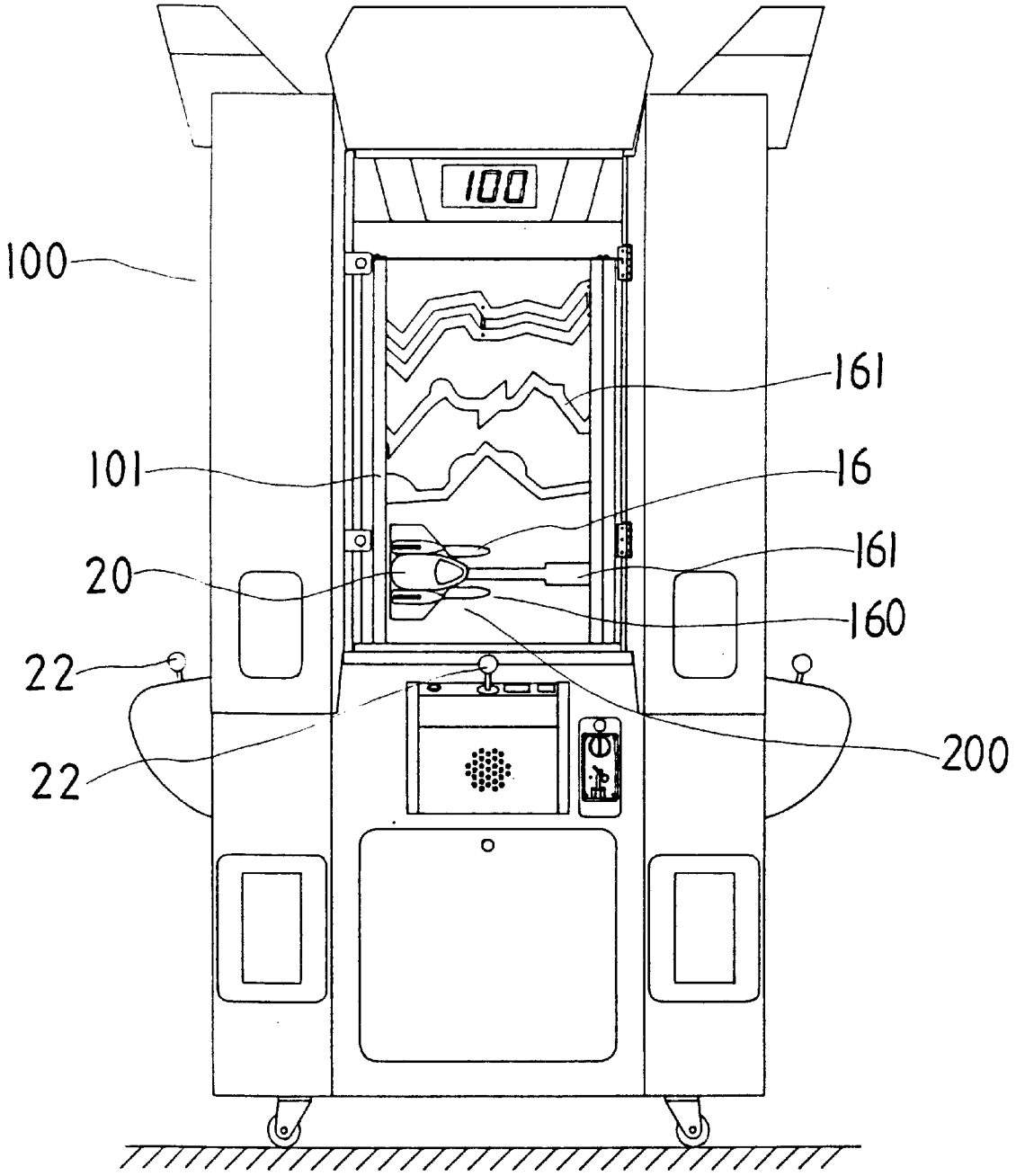
FIG. 5 is a front elevation of a path game unit with the present invention mounted therein.

Please refer to FIG. 5 which shows a path game unit 100 in which an assembly 200 of flexible metal contact bars of the present invention is mounted. As shown, the unit 100 is provided with a vertically extended long rail 101 for the assembly 200 of the flexible metal contact bars to move up and down along it. The path 161 spirally extends upward in the path game unit 100 and is defined by two generally parallel borders. Irregular curves and bends may be contained in the path 161 at any position, so long as the space between the two borders does not exceed a predetermined distance. The spiral path 161 is in a rotating state before the assembly 200 of the flexible contact bars of the path game unit 100 is actuated by inserting an coin into the unit 100. The actuated assembly 200 is moved to a beginning of the path 161. At this point, the shaft 3 rotates and frictionally contacts with the rubber pad 8 on the top of the driven sliding block 9 to bring the driven sliding block 9 to move toward the path 161 with the two electrodes 160 separately locate above and below the path 161. Rockers 22 are provided on control panels of the path game unit 100 for each controlling an assembly 200 of flexible contact bars to timely move up or down along the rail 101, lest the projected electrodes 160 should contact with the borders of the path 161. More particularly, since the electrodes 160 are fixedly connected at their one end to the insulating electrode holders 16 which are fixedly attached to the electrode fixing plate 11, and each of the electrodes 160 consists of a first and a second contact bar 17, 18 flexibly connected to one another by the spring 19, a player must try to control the assembly 200 of flexible contact bars to move upward along the vertical rail 101 while keeps the electrodes 160, particularly the second contact bars 18 of the electrodes 160, from contacting with borders of the rotating spiral path 161. Since the spiral path 161 keeps rotating during the game, the assembly 200 of flexible contact bars moving upward along the rail 101 is gradually moved from the beginning of the path 161 at a lower level toward an end of the path 161 at a higher level in the path game unit 100. If any border of the path 161 is touched by the first or the second metal contact bar 17 or 18 of any electrode 160 when the assembly 200 is moving toward the end of the path 161, sparks and sounds will be immediately generated. Flashes will also be produced in the clear window 21 of the decorative shell 20 to make the game more exciting. At this point, the assembly 200 is forced to move away from the path 161 and lowered along the rail 101 to an original starting point of the game and is ready for a next round of game.

Figure 4A:
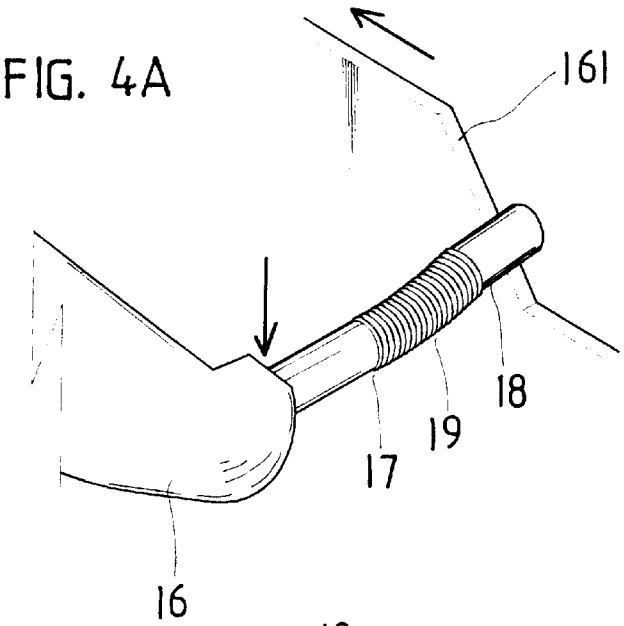
FIGS. 4A to 4D illustrate how the metal contact bar of the present invention is biased by the flexible spring when the electrode collides with the path at different positions.
Figure 4B:
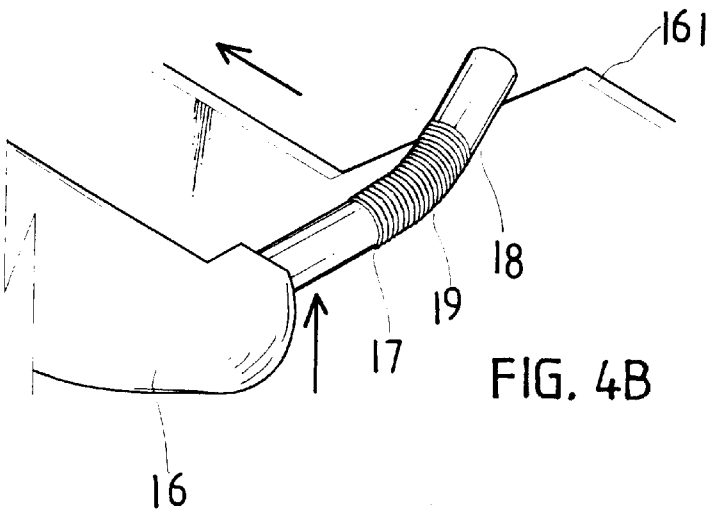
Figure 4C:
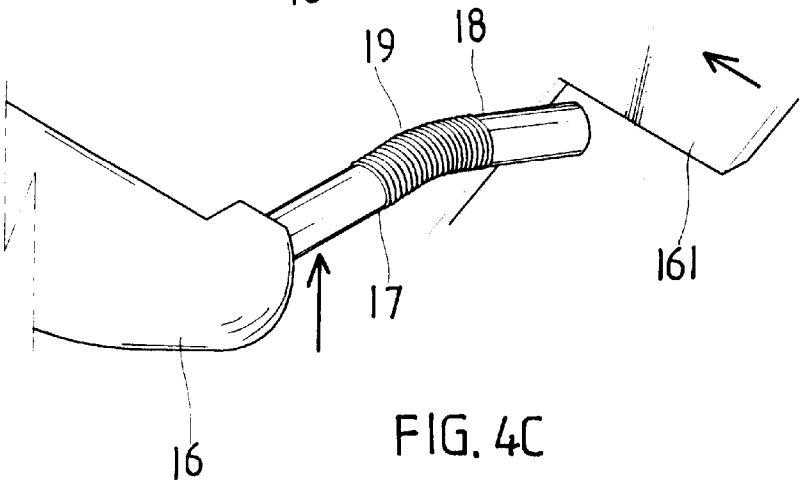
Figure 4D:
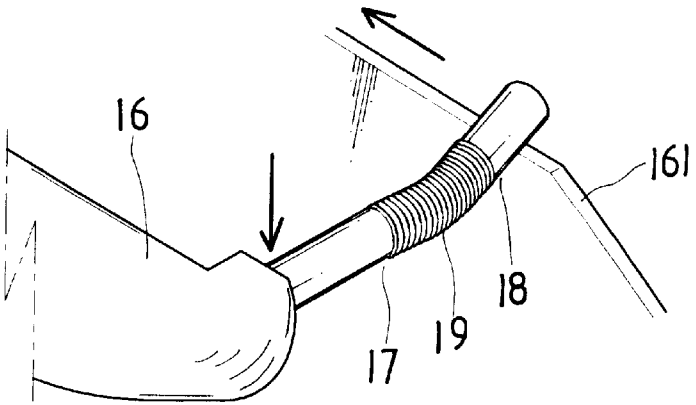

Please now refer to FIGS. 4A to 4D. There are chances that the electrodes 160 of the present invention would touch or even collide with any point on the borders of the rotating spiral path 161 during the game. When the assembly 200 of flexible metal contact bars is moved by manipulating the rocker 22 of the path game unit 100, and a left side of one of the second metal contact bars 18 forming front ends of the electrodes 160 collides with the border of the path 161, the spring 19 connecting the second contact bar 18 to the first contact bar 17 will flex to allow the second metal contact bar 18 to bias rightward relative to the first metal contact bar 17, as shown in FIG. 4A. Or, when a right side of one of the second metal contact bar 18 collides with the border of the path 161, the spring 19 flexes to allow the second metal contact bar 18 to bias leftward relative to the first metal contact bar 17, as shown in FIG. 4B. When an upper side of the second metal contact bar 18 collides with the border of the path 161, the spring 19 flexes to allow the second metal contact bar 18 to bias downward relative to the first metal contact bar 17, as shown in FIG. 4C. Similarly, when a lower side of the second metal contact bar 18 collides with the border of the path 161, the spring 19 flexes to allow the second metal contact bar 18 to bias upward relative to the first metal contact bar 17, as shown in FIG. 4D. Since the springs 19 may flex in all directions to allow the second metal contact bars 18 of the electrodes 160 to bias whenever they collide with the path 161, the second metal contact bars 18 may return to their original positions and shapes after the assembly 200 of flexible metal contact bars is forced to move away from the path 161. The electrodes 160 will not be stuck in the path 161 or be deformed due to collision with the path 161. This allows the path 161 to contain more changeful and difficult curves and bands in its design to make the game even more exciting without damaging the motor of the path game unit 100.

The first and the second metal contact bars 17, 18 as well as the spring 19 are preferably made of stainless steel material, so that they are not subject to easy wear or rust after contacting with the path 161 to produce sparks many times. The stainless steel made electrodes 160 provide good induction effect and allow longer usable life of the present invention.

What is claimed is:

1. An assembly of flexible metal contact bars for coin-operated path game unit, said path game unit including a constantly rotating spiral path and a long rail to which said assembly of flexible metal contact bars is attached to move up and down in said path game unit and to move from a beginning of said spiral path to an end of said path, said assembly of flexible metal contact bars comprising a frame, a fixed supporting block, a driven sliding block, two electrodes, a cover member covered onto said frame, and a decorative shell attached to a front side of said cover;

said fixed supporting block being fixedly mounted to a middle portion in said frame, a shaft to be rotatably connected to a motor of said path game unit sideward projecting from said fixed supporting block and having a rubber ring provided around said shaft, such that when a coin is inserted into said path game unit to start said motor, said shaft and said rubber ring are rotated;

said driven sliding block being slidably mounted on two slide rails fixedly mounted to a lower portion in said frame, such that said sliding block is located to one side of said fixed supporting block with a rubber pad attached to a top of said sliding block frictionally contacting with said rubber ring around said shaft projecting from said fixed supporting block, whereby said sliding block is moved on said guide rails toward said path when said shaft and said rubber ring are rotated; and said electrodes being fixedly held by two insulating electrode holders which are horizontally and parallelly attached to and projecting from a fixing plate, said fixing plate being fixedly mounted to said sliding block so as to move along with said sliding block, each of said electrodes being formed from at least two metal contact bars connected to one another by means of springs, a first metal contact bar of said at least two metal contact bars being fixedly connected to a free end of said electrode holder and a last metal contact bar of said at least two metal contact bars forming a free end of said electrode, said electrodes being perpendicular to said electrode holders and extending toward said spiral path in said path game unit, such that when said sliding block is moved toward said path, said two electrodes separately locate above and below said path;

whereby when any of said electrodes gets in contact with said path, said springs connecting said at least metal contact bars of said electrode flex to allow said metal contact bars to bias from said path without fiercely colliding with said path and becoming damaged.

2. An assembly of flexible metal contact bars for coin-operated path game unit as claimed in claim 1, wherein said at least two metal contact bars are provided at ends facing said springs with external threads, whereby said springs are connected at two ends to said metal contact bars by engaging with said external threads.

3. An assembly of flexible metal contact bars for coin-operated path game unit as claimed in claim 1, wherein said at least two metal contact bars as well as said springs are preferably made of stainless steel material.

4. An assembly of flexible metal contact bars as claimed in claim 1, wherein said electrodes are preferably formed from two metal contact bars connected to each other by said springs.

* * * * *